US009033130B2

(12) United States Patent
Saiki

(10) Patent No.: US 9,033,130 B2
(45) Date of Patent: May 19, 2015

(54) BANKNOTE PROCESSING DEVICE

(71) Applicant: Oki Electric Industry Co., Ltd., Tokyo (JP)

(72) Inventor: Yoshihiro Saiki, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/131,883

(22) PCT Filed: Oct. 5, 2012

(86) PCT No.: PCT/JP2012/076031

§ 371 (c)(1),
(2) Date: Jan. 9, 2014

(87) PCT Pub. No.: WO2013/080670

PCT Pub. Date: Jun. 6, 2013

(65) Prior Publication Data

US 2014/0166432 A1 Jun. 19, 2014

(30) Foreign Application Priority Data

Nov. 28, 2011 (JP) ..... 2011-259189

(51) Int. Cl.

| | |
|---|---|
| ***G07D 7/00*** | (2006.01) |
| ***G07F 7/04*** | (2006.01) |
| ***G07D 11/00*** | (2006.01) |
| ***G07D 7/20*** | (2006.01) |

(52) U.S. Cl.

CPC ..... *G07D 11/0021* (2013.01); *G07D 7/20* (2013.01); *G07D 11/0018* (2013.01); *G07D 11/0066* (2013.01); *G07D 11/0084* (2013.01); *G07D 7/00* (2013.01)

(58) Field of Classification Search

CPC ..... G07D 7/00; G07D 7/20; G07D 11/0021; G07D 11/0033; G07D 2211/00

USPC ..... 194/200, 206, 207, 302; 209/534; 235/379

See application file for complete search history.

(56) References Cited

U.S. PATENT DOCUMENTS

| | | | | |
|---|---|---|---|---|
| 6,006,209 | A | 12/1999 | Takeuchi et al. | |
| 2009/0229947 | A1 * | 9/2009 | Takai et al. | 194/206 |
| 2012/0066730 | A1 | 3/2012 | Jiang | |

FOREIGN PATENT DOCUMENTS

| | | | |
|---|---|---|---|
| JP | H10-149474 | A | 6/1998 |
| JP | 2001-093022 | A | 4/2001 |
| JP | 2010-224738 | A | 10/2010 |
| JP | 2012-108820 | A | 6/2012 |
| RU | 2351988 | C2 | 4/2009 |
| RU | 2372662 | C2 | 11/2009 |
| WO | WO-2010/109606 | A1 | 9/2010 |

OTHER PUBLICATIONS

Russian Office Action with English translation dated Jan. 26, 2015, PCT/JP2012/076031 (5 pages).

* cited by examiner

*Primary Examiner* — Mark Beauchaine
(74) *Attorney, Agent, or Firm* — Rabin & Berdo, P.C.

(57) ABSTRACT

A currency note processing device has a deposit opening. A currency note recognition section recognizes unique information of a deposited currency. A currency note storage section accumulates the deposited currency notes. A transportation control section controls the transportation of the deposited currency note such that the currency note is transported directly to the currency note storage section, and when a return instruction for the deposited currency note is detected, controls the transportation of the deposited currency note from the currency note storage section to the currency note recognition section. A comparison section compares the unique information recognized at the time of the first transportation, from the deposit opening to the currency note recognition section, is compared to unique information recognized at the time of the second transportation, from the currency note storage section to the currency note recognition section.

7 Claims, 17 Drawing Sheets

BANKNOTE PROCESSING DEVICE

TECHNICAL FIELD

The present invention relates to a banknote processing device.

BACKGROUND ART

Heretofore, cash processing devices, as represented by service counter cash processors installed at the counters of service branches of financial institutions, have been used for banknote and coin deposit and withdrawal transactions, and for inventory updates and the like. A staff member may carry out transactions such as deposits, withdrawals and the like by performing various operations from an operation section of a cash processing device or from a service terminal (information processing device) connected to the cash processing device.

This cash processing device may be disposed between two tellers (operators), and deposits and withdrawals of banknotes and coins may be carried out by the two tellers. Japanese Patent Application Laid-Open (JP-A) No. 2001-93022 discloses a circulation type currency processor with a structure in which, when the device is disposed between and used by two tellers, the disposition of a banknote deposit aperture and suchlike can be altered so as to make operations easier for either of the two tellers at left and right.

Beside service counter cash processors, the above-mentioned cash processing device architecture may be applied to a cash processing section of an automated teller machine (ATM), as represented by an ATM in a financial institution. JP-A No. 2010-224738 discloses an operation of a coin processing device in an ATM, which operation is a direct coin deposit in which received coins are fed to a coin storage chute and ultimately to a coin storage cassette directly, rather than being temporarily held in a temporary holding section.

DISCLOSURE OF INVENTION

Technical Problem

In a banknote processing device that deals with banknotes, cash processing times may be shortened by, similarly to the above-described direct coin deposit, conveying banknotes directly to banknote cassettes without temporarily holding the banknotes at a temporary holding section.

However, when deposited banknotes are returned to a customer after a direct deposit, in contrast to a return of deposited banknotes in a case in which the customer's banknotes have been temporarily held in the temporary holding section, it is difficult to check whether the banknotes returned to the customer are assuredly the actual banknotes deposited by the customer.

Accordingly, the present invention has been made in consideration of the problem described above, and an object of the present invention is to provide a new and improved banknote processing device that may confirm whether or not actual deposited banknotes are assuredly returned.

Solution To Problem

In order to solve the problem described above, in accordance with an aspect of the present invention, provided is a banknote processing device that includes: a deposit aperture; a banknote verification section that recognizes characteristic information of deposited banknotes conveyed from the deposit aperture; a banknote storage section in which the deposited banknotes are stacked; a conveyance control section that controls conveyance of the deposited banknotes conveyed from the deposit aperture to the banknote verification section such that the deposited banknotes are conveyed directly to the banknote storage section, and that, when a deposited banknote return command is detected, controls conveyance of the deposited banknotes such that the deposited banknotes are conveyed from the banknote storage section to the banknote verification section; and a comparison section that compares the characteristic information recognized at the time of a first conveyance from the deposit aperture to the banknote verification section with characteristic information recognized at the time of a second conveyance from the banknote storage section to the banknote verification section.

The banknote processing device may further include a memory section that, when the comparison section determines that the characteristic information recognized at the time of the second conveyance differs from the characteristic information recognized at the time of the first conveyance, memorizes a characteristic information error, and the conveyance control section may control conveyance such that the deposited banknotes conveyed from the banknote storage section to the banknote verification section are ejected regardless of the results of the comparison by the comparison section.

The conveyance control section may control conveyance so as to eject each deposited banknote of which the characteristic information recognized at the time of the second conveyance is determined by the comparison section to match the characteristic information recognized at the time of the first conveyance.

The banknote processing device may further include a temporary holding section that temporarily stores the deposited banknotes, wherein the conveyance control section controls so as to convey each deposited banknote of which the characteristic information recognized at the time of the second conveyance is determined by the comparison section to differ from the characteristic information recognized at the time of the first conveyance to the temporary holding section.

The banknote processing device may further include a general-purpose banknote storage section that stores banknotes for use in at least one of restocking and recovery of banknotes, and the conveyance control section may control so as to convey each deposited banknote of which the characteristic information recognized at the time of the second conveyance is determined by the comparison section to differ from the characteristic information recognized at the time of the first conveyance to the general-purpose banknote storage section.

The conveyance control section may control conveyance of the deposited banknotes stored at the temporary holding section or the general-purpose banknote storage section such that these deposited banknotes return to the banknote storage section and, after the deposited banknotes have returned, may repeat the second conveyance that conveys the deposited banknotes from the banknote storage section to the banknote verification section.

The conveyance control section may repeat the second conveyance a predetermined number of times.

The comparison section may compare the characteristic information recognized at the time of the second conveyance with characteristic information of banknotes stored in the banknote storage section at the time of a previous transaction, and when the characteristic information recognized at the time of the second conveyance matches the characteristic information of a banknote stored at the time of the previous transaction, the conveyance control section may control conveyance so as to eject each deposited banknote stored at the temporary holding section or the general-purpose banknote storage section that has been conveyed to the banknote verification section before the deposited banknote with the matching characteristic information.

Advantageous Effects of Invention

According to the present invention as described hereabove, it may be confirmed whether or not actual deposited banknotes have been assuredly returned.

BEST MODE FOR CARRYING OUT THE INVENTION

Figure 1:
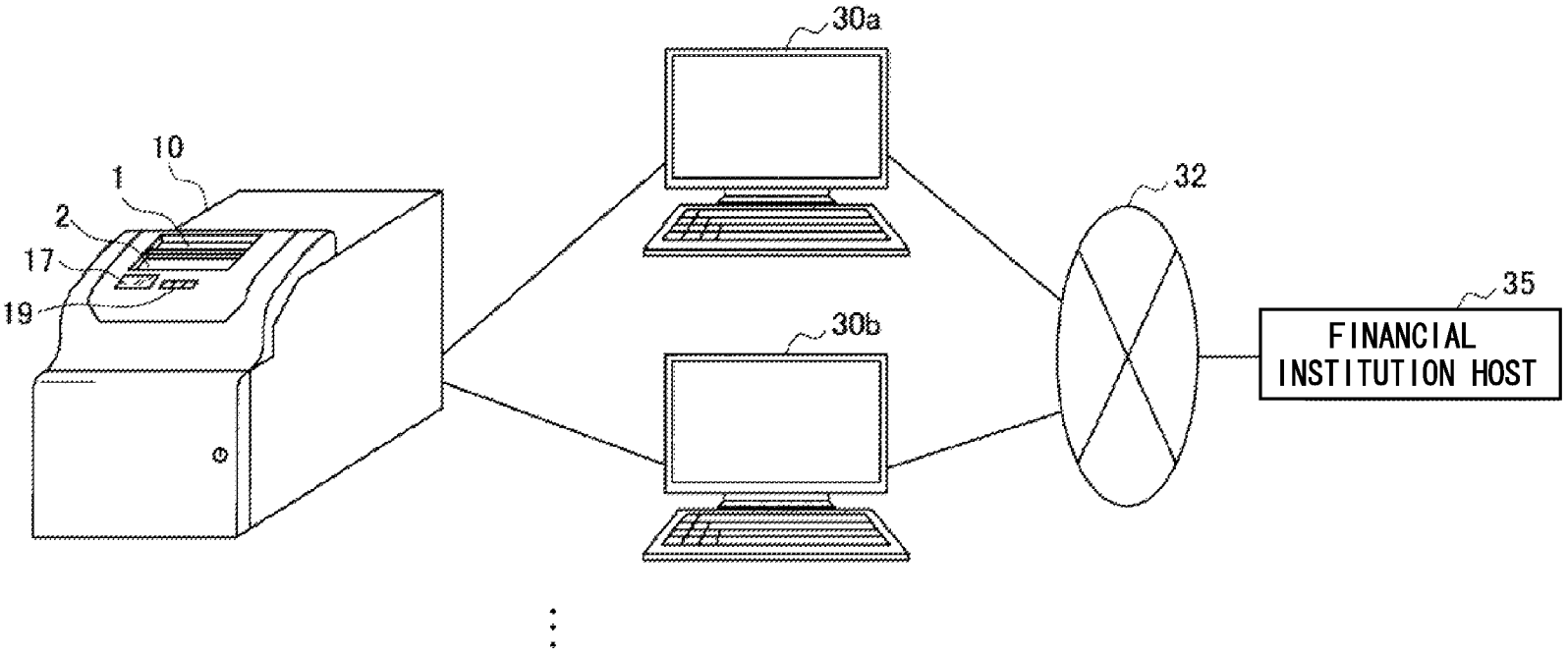
FIG. 1 is a descriptive diagram showing structures of a banknote processing system in accordance with an embodiment of the present invention.

Herebelow, a preferable embodiment of the present invention is described in detail while referring to the attached drawings. In the present specification and drawings, structural elements with substantially the same functional structures are assigned the same reference numerals, and duplicative descriptions thereof are omitted accordingly.

1. Outline of Banknote Processing System

First, general features of a banknote processing system in accordance with an embodiment of the present invention are described with reference to FIG. 1.

FIG. 1 is a descriptive diagram showing structures of the banknote processing system according to the embodiment of the present invention. As shown in FIG. 1, the banknote processing system includes a banknote processing device 10, service terminals 30*a* and 30*b* that are connected to the banknote processing device 10, a dedicated network 32, and a financial institution host 35. In the example shown in FIG. 1, plural service terminals 30 are connected to the banknote processing device 10. However, a banknote processing system in accordance with the present embodiment is not limited thus: a single service terminal 30 may be connected to the banknote processing device 10. Each service terminal 30 is also connected to the financial institution host 35 via the dedicated network 32.

The banknote processing device 10 is a staff-operated terminal that executes cash transactions in accordance with operations by staff members such as the front counter staff of the financial institution. The banknote processing device 10 is installed in a service branch of the financial institution or the like.

As shown in FIG. 1, the banknote processing device 10 is equipped with a deposit aperture 1 at which banknotes are inserted, a withdrawal aperture 2 at which banknotes are ejected, a display section 17, and an operation section 19. The display section 17 displays menu screens, processing result screens and the like. The display section 17 is implemented with, for example, a cathode ray tube (CRT) display device, a liquid crystal display (LCD) device or an organic light-emitting diode (OLED) device. The operation section 19 detects operations by a staff member. The operation section 19 is implemented with, for example, buttons, switches and a touch panel or the like. In FIG. 1, the display function and the operation function are provided separately, but the banknote processing device 10 in accordance with the present embodiment is not limited thus. The display function and the operation function may be integrally provided. The banknote processing device 10 may display guidance screens guiding operations by a staff member at a display screen that features an operation detection function.

The deposit aperture 1 is an insertion aperture at which the staff member inserts banknotes. The deposit aperture 1 is provided with a shutter (not shown in the drawings) that opens and closes an opening portion. The deposit aperture 1 features a separation function that separates banknotes inserted in a bundle and feeds the banknotes one by one.

The withdrawal aperture 2 is an ejection aperture at which banknotes to be collected by the staff member are ejected. The withdrawal aperture 2 is provided with a shutter (not shown in the drawings) that opens and closes an opening portion. The withdrawal aperture 2 features a stacking function that stacks the banknotes being ejected.

Each service terminal 30 is an information processing device that executes service tasks. The service terminal 30 is connected with the banknote processing device 10 by wire or by wireless, and sends commands such that processing modes selected by the staff member (deposit and withdrawal transactions, withdrawal aperture recoveries, inventory updates and the like) are executed by the banknote processing device 10. Thus, the banknote processing device 10 according to the present embodiment may be operated from an information processing device connected to the banknote processing device 10 as well as from the aforementioned operation section 19 provided at the banknote processing device 10.

The dedicated network 32 is a network in the service branch at which the service terminals 30 are provided, or in the financial institution covering plural service branches. The dedicated network 32 is constituted by, for example, an IP-VPN (Internet protocol virtual private network). The financial institution host 35 may communicate with the plural service terminals 30 via the dedicated network 32.

The financial institution host 35 controls various transactions by communicating with each service terminal 30 via the dedicated network 32 or communicating with the banknote processing device 10 via the service terminal 30. For example, the financial institution host 35 authenticates customers and executes cash transactions (account transaction processing) such as deposits, transfers and the like that are instructed by the staff member. The financial institution host 35 also administers customer information (an account ledger) such as an account number, PIN number, name, address, age, birth date, telephone number, occupation, household members, income, deposit balance and so forth.

An embodiment of the present invention relates to the banknote processing device 10 included in the banknote processing system described hereabove, and particularly relates to control of returns of deposited banknotes in the banknote processing device 10. Herebelow, the structure and basic operations of the banknote processing device 10 are described, after which deposited banknote return control in accordance with the embodiment of the present invention is described in detail.

2. Structure And Basic Operations of the Banknote Processing Device 10

2-1. Internal Structures

Figure 2:
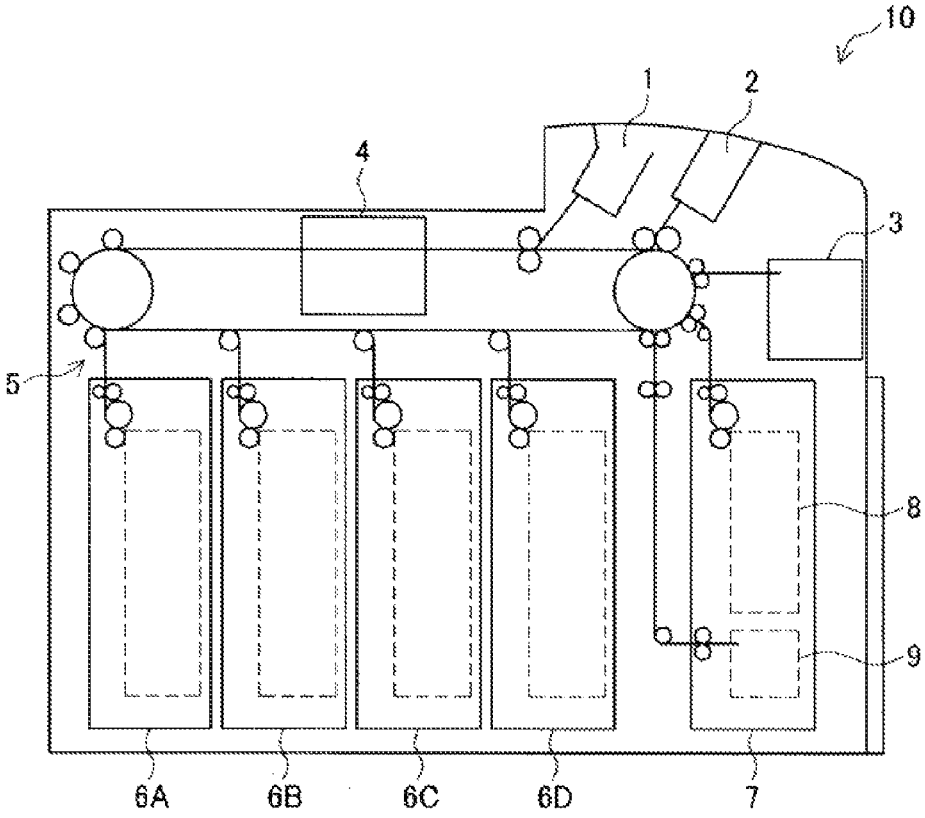
FIG. 2 is a diagram showing internal structures of a banknote processing device in accordance with the embodiment of the present invention.

FIG. 2 is a diagram showing internal structures of the banknote processing device 10. As shown in FIG. 2, the banknote processing device 10 includes the deposit aperture 1, the withdrawal aperture 2, a temporary holding section 3, a banknote verification section 4, a conveyance section 5, banknote cassettes 6A to 6D, and a banknote cassette with a reject vault 7. The banknote cassette with a reject vault 7 includes a banknote storage vault 8 and a reject vault 9.

As described above, the deposit aperture 1 features a separation function that feeds inserted banknotes one by one. Further, as described above, the withdrawal aperture 2 features a stacking function that stacks banknotes to be ejected. The deposit aperture 1 and withdrawal aperture 2 may be movable such that they may be angled to the side of a conveyance path, angled to the side of a loading aperture for a staff member, and the like.

The temporary holding section 3 features functions of both separation and stacking of banknotes. For example, during a deposit transaction, the temporary holding section 3 temporarily stacks banknotes that have been separated from the deposit aperture 1 and identified as proper by the banknote verification section 4. When the transaction is completed, such as when an account total of the deposited banknotes or the like is confirmed or the like, the banknotes stacked in the temporary holding section 3 are fed out and are conveyed through the banknote verification section 4 to the banknote cassettes 6A to 6D or the like. The temporary holding section 3 may be of a stacking type in which banknotes are successively superposed and stacked, or may be of a drum type in which banknotes are successively wound on to be stored.

The banknote verification section 4 authenticates banknotes passing therethrough one by one. The banknote verification section 4 can deal with banknotes progressing in both directions: it may authenticate banknotes being conveyed in the direction from the deposit aperture 1 and banknotes being conveyed in the opposite direction. To be specific, the banknote verification section 4 identifies the denomination of a banknote being conveyed along the conveyance path, whether the banknote is authentic or not, whether the banknote is intact or damaged, a traveling state of the banknote, and the like. Thus, the banknote verification section 4 determines whether a banknote passing through is proper or a reject. A reject determination can be based on factors such as inauthenticity, damage (staining, tearing, abnormal shape or the like), and traveling problems (a skewed banknote, double-feeding or the like). Reject banknotes may also include 2,000 yen notes and 5,000 yen notes where these cannot be used as withdrawal banknotes, and may include foreign banknotes.

The conveyance section 5 includes conveyance paths that convey the banknotes, conveyance rollers, and driving mechanisms that drive the conveyance paths. A driving mechanism drives a conveyance path by, for example, rotation of a DC servo motor or a pulse motor or the like. The conveyance section 5 is controlled by a control section, which is described below (see a control section 11 in FIG. 3), and conveys the banknotes to target conveyance destinations.

The banknote cassettes 6A to 6D are banknote storage sections in which banknotes can be stored in respective denominations, and feature functions of both stacking and separating banknotes. The banknote cassettes 6A to 6D may include a plural number of cassettes that store the same denomination. For example, the banknote cassettes 6A and 6C may be banknote cassettes for 10,000 yen notes and the banknote cassettes 6B and 4D may be banknote cassettes for 1,000 yen notes. The banknote cassettes 6A to 6D may be structures that can be mounted at and removed from the banknote processing device 10, and banknotes may be loaded in the banknote cassettes 6A to 6D by the banknote cassettes 6A to 6D being replaced as units. Note that a banknote storage section according to the present embodiment is not limited to cassettes that can be mounted at and removed from the banknote processing device 10, but may be stackers (banknote stackers A to D) that cannot be mounted at and removed from the banknote processing device 10.

The banknote cassette with a reject vault 7 (which is also referred to hereinafter as "the banknote cassette 7") is equipped with the banknote storage vault 8 at the upper side thereof and the reject vault 9 at the lower side (a floor portion) thereof. The banknote cassette 7 is a structure that can be mounted at and removed from the banknote processing device 10, and banknotes may be recovered and re-stocked by the banknote cassette 7 being replaced as a unit.

The banknote storage vault 8 features the stacking function that stacks banknotes and the separation function that feeds banknotes one by one. The banknote storage vault 8 stacks banknotes separated from the banknote cassettes 6A to 6D at a time of cassette counting and recovery, and may recover these banknotes. For cassette counting and re-stocking, the banknote storage vault 8 may feed stored banknotes and re-stock the banknotes in the banknote cassettes 6. That is, the banknote storage vault 8 is a general-purpose banknote storage section that may be used for multiple purposes.

The reject vault 9 features only the stacking function that stacks banknotes. The reject vault 9 is a banknote storage section for stacking banknotes (reject banknotes) identified as abnormal by the banknote verification section 4 (reject determination).

Hereabove, the internal structures of the banknote processing device 10 included in the banknote processing system according to the present embodiment are described in detail. Now, functional structures of the banknote processing device 10 according to the present embodiment are described.

2-2. Functional Structures

Figure 3:
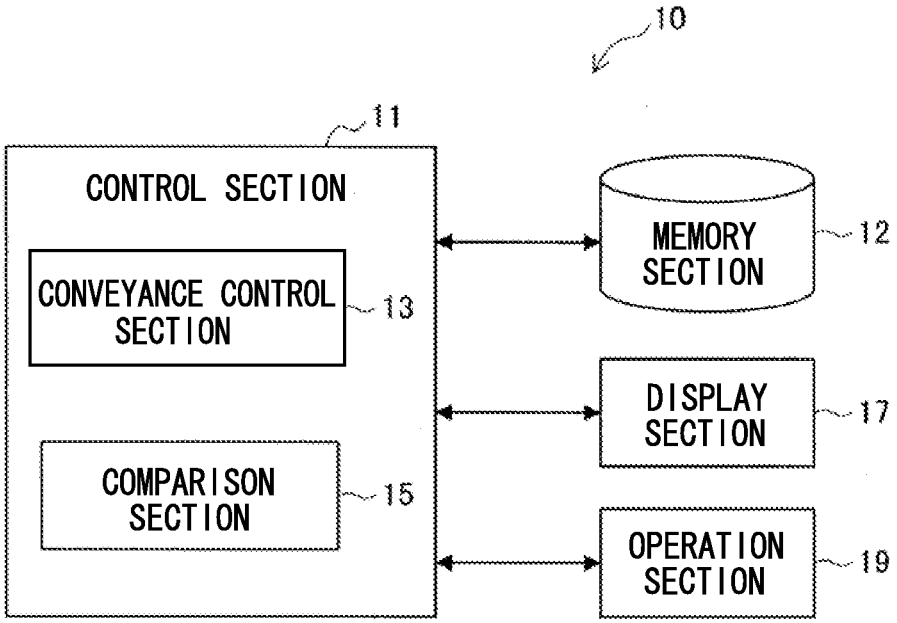
FIG. 3 is a block diagram showing functional structures of the banknote processing device in accordance with the embodiment of the present invention.

FIG. 3 is a block diagram showing the functional structures of the banknote processing device 10 according to the present embodiment. As shown in FIG. 3, the banknote processing device 10 is provided with the control section 11, a memory section 12, the display section 17 and the operation section 19. The respective structures are described herebelow. The display section 17 and the operation section 19 have been described in reference to FIG. 1, so descriptions thereof are not given here.

The control section 11 controls overall operations of the banknote processing device 10. Specifically, the control section 11 controls basic operations such as deposits, withdrawals, recoveries and inventory updates. Details of these basic operations are described below in section "2-3. Basic Operations". The control section 11 also controls the banknote processing device 10 as a whole so as to execute basic operations instructed by a staff member through the operation section 19 and basic operations instructed by a staff member through the service terminal 30.

The control section 11 according to the present embodiment includes a conveyance control section 13 and a comparison section 15. By controlling the conveyance section 5, the conveyance control section 13 controls conveyances of banknotes in basic operations such as deposits, withdrawals, recoveries and inventory updates. The conveyance control section 13 may control the conveyance of banknotes in accordance with verification results by the banknote verification section 4, and may control a return of deposited banknotes in accordance with results of comparisons by the comparison section 15. The comparison section 15 compares serial numbers of banknotes being returned with the serial numbers of deposited banknotes. Control of the return of deposited banknotes by the conveyance control section 13 and the comparison section 15 is described in detail herebelow, in section "3. Deposited Banknote Return Control".

The memory section 12 memorizes the serial numbers of deposited banknotes, which are recognized by the banknote verification section 4. When the serial number of a banknote being returned is determined by the comparison section 15 to be different from the serial number of the deposited banknote, the memory section 12 memorizes a serial number error.

Hereabove, the functional structures of the banknote processing device 10 according to the present embodiment are described. The functions of the above-described control section 11 (the conveyance control section 13 and the comparison section 15) and the memory section 12 may be realized by a hardware structure formed of a central processing unit (CPU), read-only memory (ROM), random access memory (RAM) and suchlike. The CPU features computation functions and control functions, and controls overall operations of the banknote processing device 10 in accordance with various programs. The ROM memorizes programs, computation parameters and the like to be used by the CPU. The RAM temporarily memorizes programs used for execution by the CPU, parameters that are altered as appropriate in the execution of programs, and the like.

2-3. Basic Operations

Deposit Transaction

Figure 4:
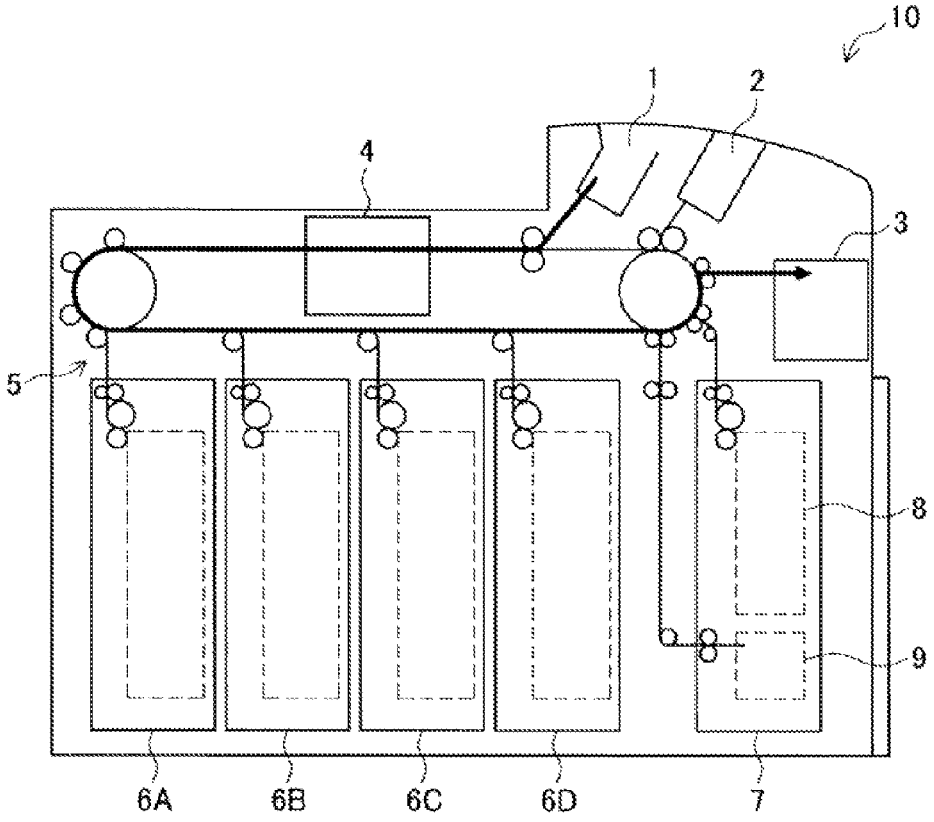
FIG. 4 is a diagram showing a conveyance path, in a deposit transaction, of a banknote that has been verified as proper by a verification result according to the banknote verification section.
Figure 5:
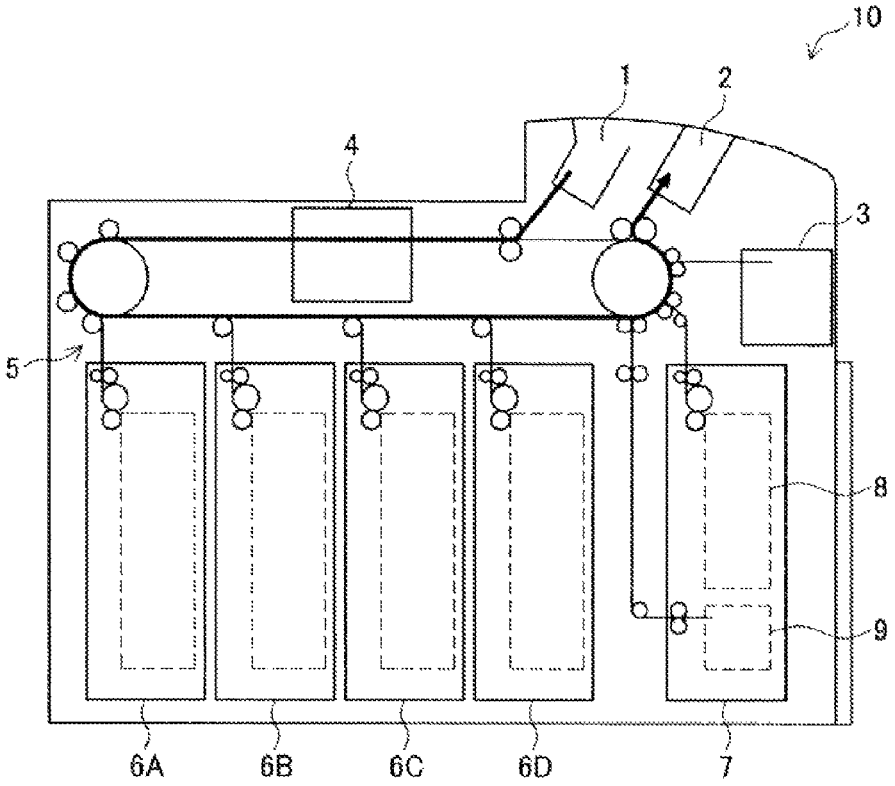
FIG. 5 is a diagram showing a conveyance path of a banknote that has been verified as abnormal (a reject banknote) by a verification result according to a banknote verification section.

A deposit transaction is described with reference to FIG. 4 and FIG. 5. FIG. 4 is a diagram showing a conveyance path, in the deposit transaction, of a banknote that is verified as proper by a verification result according to the banknote verification section 4. FIG. 5 is a diagram showing a conveyance path, in the deposit transaction, of a banknote that is verified as abnormal (a reject banknote) by a verification result according to the banknote verification section 4.

In the deposit transaction, banknotes are separated one by one from the deposit aperture 1, and each separated banknote is conveyed to the banknote verification section 4. A banknote, which is verified by the banknote verification section 4 as being proper, passes along the conveyance path shown by the arrow in FIG. 4 from the banknote verification section 4 and is stacked in the temporary holding section 3. On the other hand, a banknote that is verified by the banknote verification section 4 as being abnormal (a reject banknote) passes along the path shown by the arrow in FIG. 5 and is stacked at the withdrawal aperture 2. Banknotes stacked in the withdrawal aperture 2 may be re-inserted at the deposit aperture 1 by a staff member and re-verified. Subsequently, when a deposit amount is confirmed, the banknote processing device 10 advances to stacking processing.

In the stacking processing, the banknotes are separated one by one from the temporary holding section 3, and each separated banknote is conveyed to the banknote verification section 4. A banknote that is verified by the banknote verification section 4 as being proper is stacked in the banknote cassettes 6A to 6D in accordance with the denomination thereof. On the other hand, a banknote that is verified by the banknote verification section 4 as being abnormal (a reject banknote)—such as a damaged 10,000 yen note or 1,000 yen note, a folded note, a 2,000 yen note or 5,000 yen note, or a banknote whose traveling state is skewed or the like—is stacked in the reject vault 9.

On the other hand, if a return of the deposited banknotes (a cancellation) is instructed before a deposit amount is confirmed, the banknote processing device 10 switches to return processing. In the return processing, the banknotes are separated one by one from the temporary holding section 3, and the separated banknotes are conveyed to the banknote verification section 4. Regardless of whether the results of verification by the banknote verification section 4 are proper or abnormal, all of the banknotes are stacked at the withdrawal aperture 2.

Withdrawal Transaction

In the withdrawal transaction, banknotes are separated one by one from the banknote cassettes 6A to 6D in accordance with a specified amount, and the separated banknotes are conveyed to the banknote verification section 4.

A banknote that is verified by the banknote verification section 4 as being proper is stacked at the withdrawal aperture 2. On the other hand, a banknote that is verified by the banknote verification section 4 as being abnormal, which is to say a banknote that may not be paid to the customer, is stacked in the reject vault 9.

Re-Stocking Operation

The re-stocking operation is a basic operation for re-stocking banknotes in the banknote processing device 10. In the banknote processing device 10 according to the present embodiment, insertion aperture re-stocking, cassette replacement re-stocking and cassette counting re-stocking are available as specific re-stocking methods. Herebelow, these re-stocking methods are successively described.

Insertion Aperture Re-Stocking

Insertion Aperture re-stocking is similar to the operations of the above-described deposit transaction and stacking processing. For example, stacked banknotes are separated one by one from the deposit aperture 1 (insertion aperture), and the separated banknotes are conveyed to the banknote verification section 4. A banknote that is verified by the banknote verification section 4 as being proper is temporarily withdrawn to the temporary holding section 3, and subsequently stacked in the banknote cassette 6A to 6D corresponding to the denomination thereof. On the other hand, a banknote that is verified by the banknote verification section 4 as being abnormal is stacked at the withdrawal aperture 2.

Cassette Replacement Re-Stocking

In the cassette replacement re-stocking, the fact that the banknote cassettes 6A to 6D are removable is utilized, and banknotes are re-stocked by one of the banknote cassettes 6A to 6D being replaced with a banknote cassette that is pre-loaded with banknotes. In cassette replacement re-stocking, the denominations and numbers of re-stocked banknotes must be manually registered by an operator.

Cassette Counting Re-Stocking

In cassette counting re-stocking, banknotes are pre-loaded into the banknote storage vault 8 of the banknote cassette 7, and the banknote cassette 7 is installed in the banknote processing device 10. The banknotes are fed one by one from the banknote storage vault 8, and the fed banknotes are conveyed to the banknote verification section 4. A banknote that is verified by the banknote verification section 4 as being proper is stacked in the banknote cassettes 6A to 6D in accordance with the denomination thereof. On the other hand, a banknote that is verified by the banknote verification section 4 as being abnormal is stacked in the reject vault 9. Thus, in cassette counting re-stocking, a counting process is executed by the banknote verification section 4, and an operator does not have to manually register the denomination and number of the re-stocked banknotes.

Recovery Operation

The recovery operation is a basic operation for recovering banknotes from inside the banknote processing device 10. In the banknote processing device 10 according to the present embodiment, withdrawal aperture recovery, cassette replacement recovery and cassette counting recovery are available as specific recovery methods. Herebelow, these recovery methods are successively described.

Withdrawal Aperture Recovery

Withdrawal aperture recovery is similar to the operations of the above-described deposit transaction. For example, first, banknotes are separated one by one from the banknote cassette 6 that is a recovery target, and the separated banknotes are conveyed to the banknote verification section 4. A banknote that is verified by the banknote verification section 4 as being proper is stacked at the withdrawal aperture 2. On the other hand, a banknote that is verified by the banknote verification section 4 as being abnormal is stacked in the reject vault 9. This process may be applied to all banknotes stacked in the recovery target banknote cassette 6, and an operator may recover the banknotes that are determined to be proper from the withdrawal aperture 2. The banknotes that are determined to be abnormal may also be recovered, from the reject vault 9.

Cassette Replacement Recovery

In the cassette replacement recovery, the fact that the banknote cassettes 6A to 6D are removable is utilized, and the recovery task is carried out by removing one of the banknote cassettes 6A to 6D in which banknotes are stacked from the banknote processing device 10. In cassette replacement recovery, an operator takes banknotes out from the banknote cassette 6 that has been removed, and must manually count the denomination and number of the recovered banknotes.

Cassette Counting Recovery

In cassette counting recovery, banknotes are fed one by one from the recovery target banknote cassette 6, and the fed banknotes are conveyed to the banknote verification section 4. Banknotes that are verified by the banknote verification section 4 as being proper are stacked in the banknote storage vault 8 of the banknote cassette 7. On the other hand, banknotes that are verified by the banknote verification section 4 as being abnormal are stacked in the reject vault 9 of the banknote cassette 7.

This process may be applied to all the banknotes stacked in the recovery target banknote cassette 6, and then an operator may recover the banknotes verified as proper and the banknotes verified as abnormal by removing just the banknote cassette 7 from the banknote processing device 10. Thus, in cassette counting recovery, a counting process is executed by the banknote verification section 4, and the operator does not have to manually count the denomination and number of the recovered banknotes.

2-4. Direct Deposit

Figure 6:
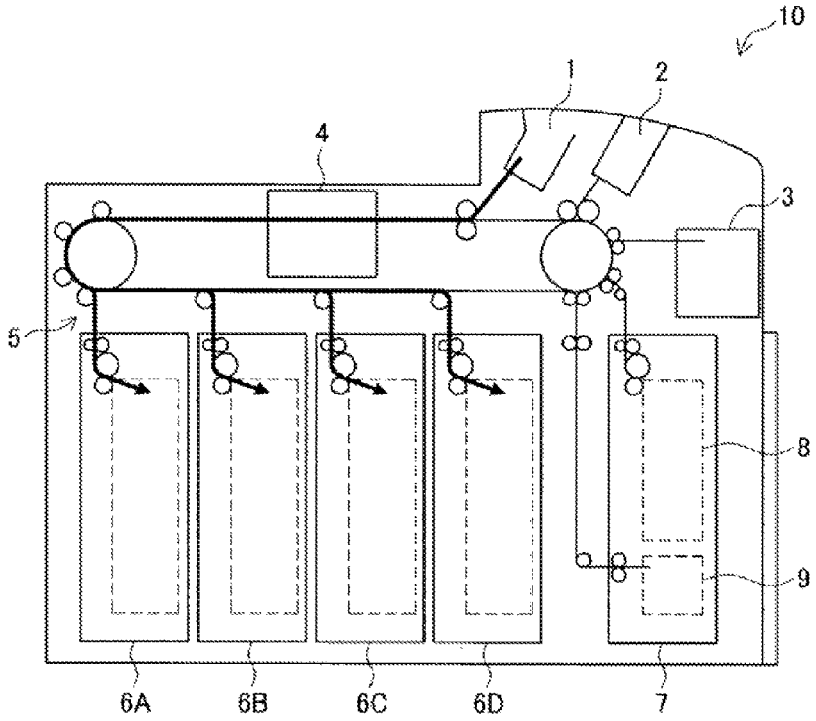
FIG. 6 is a diagram showing conveyance paths in direct deposit processing, until a banknote fed from a deposit aperture is stacked directly in a banknote cassette.

Hereabove, basic operations of the banknote processing device 10 are described. Herein, the operation of a deposit transaction may be, apart from ordinary deposit processing in which deposited banknotes are withdrawn to the temporary holding section 3 and then stacked from the temporary holding section 3 into the banknote cassettes 6, direct deposit processing in which the deposited banknotes are stacked directly into the banknote cassettes 6 without being withdrawn to the temporary holding section 3. Herebelow, the direct deposit processing is described with reference to FIG. 6. FIG. 6 is a diagram showing conveyance paths in the direct deposit processing, until banknotes fed one by one from the deposit aperture 1 are stacked in the banknote cassettes 6.

In the direct deposit processing, banknotes are separated one by one from the deposit aperture 1, and each separated banknote is conveyed to the banknote verification section 4. A banknote that is verified by the banknote verification section 4 as being proper passes along a path shown by an arrow in FIG. 6 from the banknote verification section 4 and is stacked in one of the banknote cassettes 6A to 6D in accordance with the denomination thereof. On the other hand, a banknote that is verified by the banknote verification section 4 as being abnormal (a reject banknote) is stacked in the withdrawal aperture 2. Banknotes stacked in the withdrawal aperture 2 may be re-inserted at the deposit aperture 1 by a staff member and re-verified.

Thus, in the direct deposit processing, the banknotes are not withdrawn to the temporary holding section 3 but directly stacked in the banknote cassettes 6, so the deposit processing time may be shortened compared to the ordinary deposit processing described above. Moreover, because the banknotes do not need to be withdrawn to the temporary holding section 3 in the direct deposit processing, travel of the banknotes may be reduced, and the probability of a jam occurring may be lowered. Furthermore, according to the direct deposit processing, deposit transactions may be implemented even when the temporary holding section 3 cannot be used due to a malfunction or the like or in a structure that does not include the temporary holding section 3.

However, in return processing in a case of direct deposit, it is difficult to check whether the actual banknotes deposited by the customer are assuredly returned. In the ordinary deposit processing described above, the deposited banknotes are withdrawn to the temporary holding section 3. Therefore, in deposited banknote return processing, the actual banknotes may be assuredly returned by returning all the banknotes stacked in the temporary holding section 3 to the customer. In contrast, in direct deposit processing, the deposited banknotes are stored directly to the banknote cassettes. Therefore, the banknotes are mixed with banknotes that were dealt with in other transactions. As a result, there has been no way for checking whether or not the banknotes deposited by a customer are assuredly returned in return processing that returns the banknotes from the banknote cassettes.

Accordingly, the banknote processing device 10 according to the embodiment of the present invention has been devised with regard to the circumstances described above. The banknote processing device 10 according to the embodiment of the present invention may, during return processing from a direct deposit, identify individual banknotes by comparing serial numbers and thus confirm whether or not the actual banknotes deposited by the customer are returned. Herebelow, this deposited banknote return control according to the embodiment of the present invention is described. Note that the serial numbers used in the present embodiment are an example of characteristic information that is recognized from the banknotes for identifying individual banknotes.

3. Deposited Banknote Return Control

For deposited banknote return control according to the present embodiment, first, the serial numbers of deposited banknotes are recognized by the banknote verification section 4 at the time of a first conveyance (during direct deposit processing) and are memorized in the memory section 12. Then, at the time of a second conveyance (deposited banknote return processing), the serial numbers of the banknotes being returned are compared with the serial numbers recognized at the time of the first conveyance. Thus, in the present embodiment, it may be checked whether or not the actual deposited banknotes have been assuredly returned. Herebelow, a number of embodiments of deposited banknote return control are presented and described in detail.

3-1. First Embodiment

Figure 7:
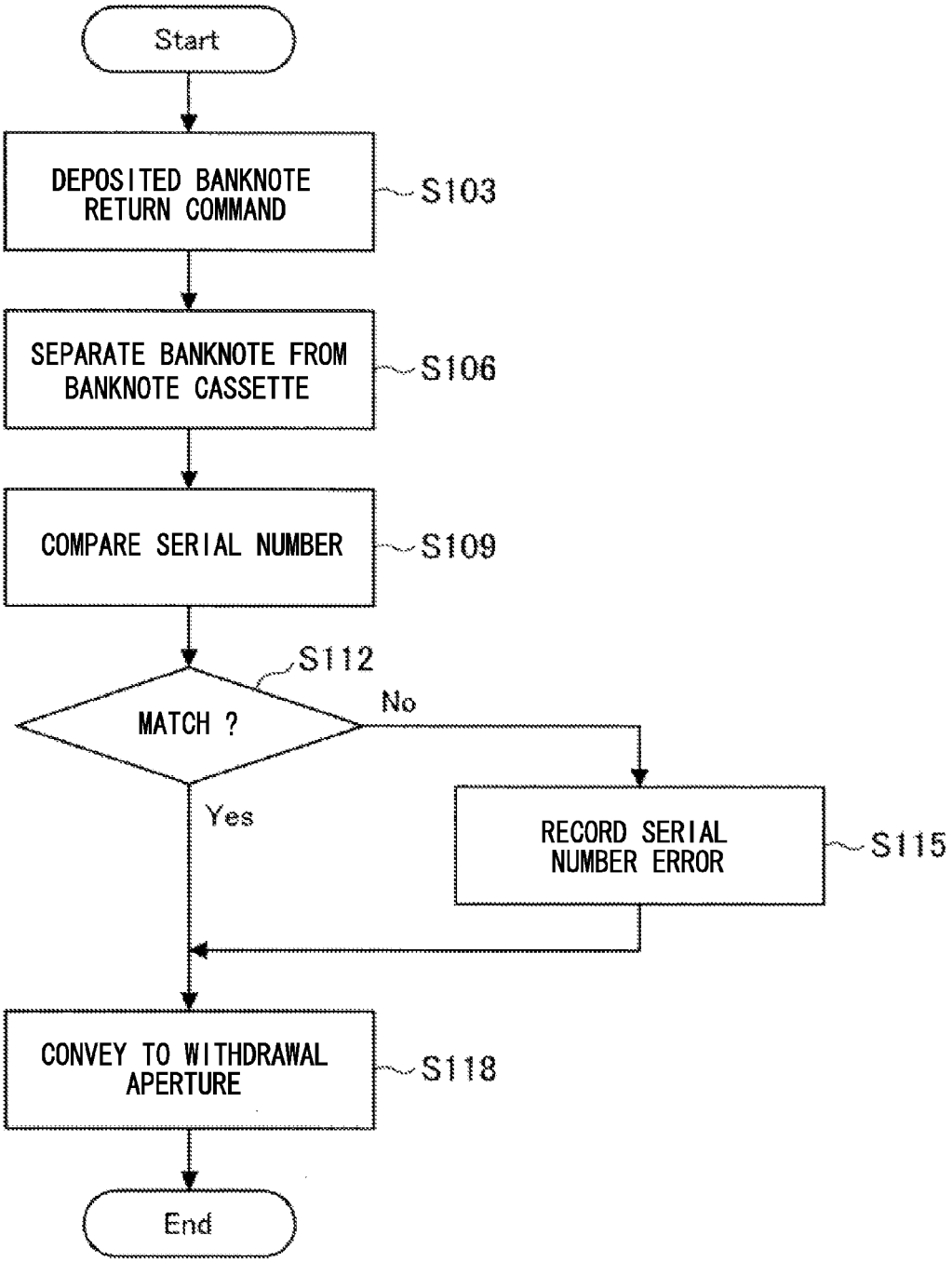
FIG. 7 is a flowchart showing return processing in accordance with a first embodiment.
Figure 8:
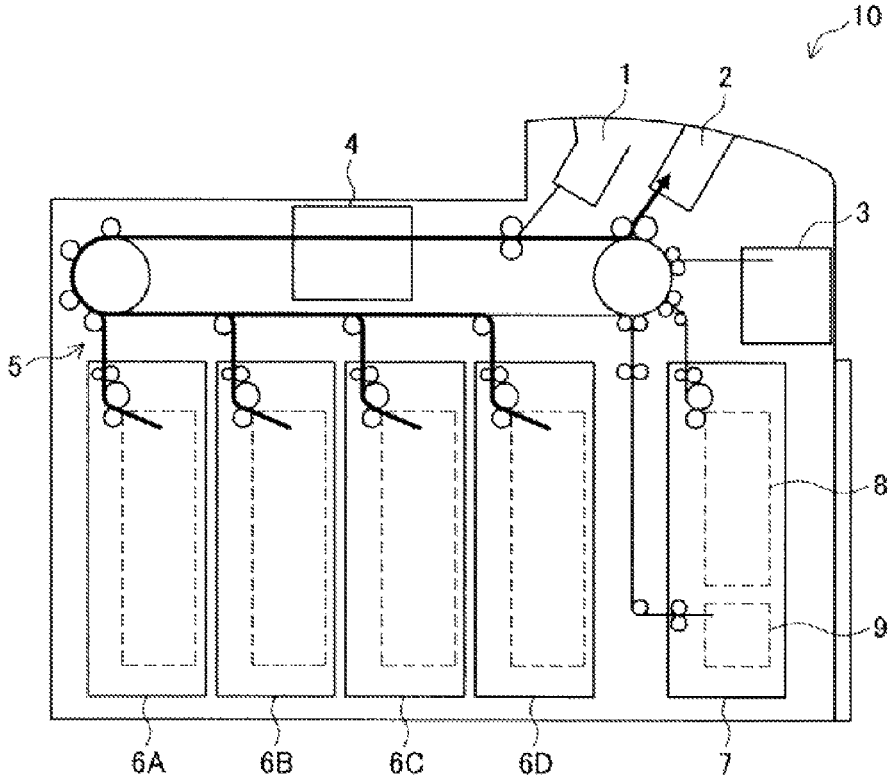
FIG. 8 is a diagram showing conveyance paths of banknotes in accordance with the first embodiment.

A return of direct deposit banknotes in accordance with a first embodiment is described with reference to FIG. 7 and FIG. 8. FIG. 7 is a flowchart showing return processing in accordance with the first embodiment. FIG. 8 is a diagram showing conveyance paths of actual deposited banknotes and error banknotes in accordance with the first embodiment.

As shown in FIG. 7, if deposited banknote return processing is instructed by a staff member at step S103, in step S106 the conveyance control section 13 separates banknotes from one or more of the banknote cassettes 6 one by one, in accordance with the denominations and numbers of deposited banknotes, and controls conveyance such that each separated banknote is conveyed to the banknote verification section 4. The banknote verification section 4 recognizes the denomination, banknote condition and serial number of the banknote.

Then, in step S109, the comparison section 15 compares the serial number of the banknote recognized by the banknote verification section 4 (characteristic information that is recognized at the time of a second conveyance) with serial numbers that were previously recognized during the direct deposit and memorized in the memory section 12 (characteristic information recognized at the time of a first conveyance). When a result of comparison by the comparison section 15 is that the serial number of the banknote recognized by the banknote verification section 4 (a banknote scheduled for return) does not match the serial number of a deposited banknote, the control section 11 may determine that the banknote scheduled for return is not an actual deposited banknote. On the other hand, when the serial number of the banknote recognized by the banknote verification section 4 (the banknote scheduled for return) matches the serial number of a deposited banknote, the control section 11 may determine that the banknote scheduled for return is an actual deposited banknote.

When the banknote scheduled for return is not an actual deposited banknote, in step S115 the control section 11 carries out processing to record a serial number error (for example, memorizing the error in the memory section 12). The control section 11 may also report the serial number error at the display section 17 of the banknote processing device 10, the service terminal 30 connected thereto or the like. Then, in step S118, the conveyance control section 13 controls the conveyance section 5 so as to convey the banknote scheduled for return from the banknote verification section 4 to the withdrawal aperture 2 and eject the banknote through the withdrawal aperture 2 (i.e., stack the banknote in the withdrawal aperture 2).

On the other hand, when the banknote scheduled for return is an actual deposited banknote, in step S118 the conveyance control section 13 controls the conveyance section 5 so as to convey the banknote scheduled for return from the banknote verification section 4 to the withdrawal aperture 2 and eject the banknote through the withdrawal aperture 2 (i.e., stack the banknote in the withdrawal aperture 2).

Thus, in the deposited banknote return processing according to the first embodiment, banknotes that are determined not to be the customer's actual deposited banknotes (having different serial numbers) are returned with a serial number error being memorized. Therefore, in the first embodiment, as well as banknotes that match the actual deposited banknotes, banknotes (serial number mismatch banknotes) that do not match the actual deposited banknotes are also conveyed along the path shown by the arrow in FIG. 8 to the withdrawal aperture 2 and returned to the customer. However, in the present embodiment, a staff member may check whether or not the actual deposited banknotes have been assuredly returned from whether or not there is serial number error information in the memory section 12.

3-2. Second Embodiment

Now, a return of direct deposit banknotes in accordance with a second embodiment is described with reference to FIG.

Figure 9:
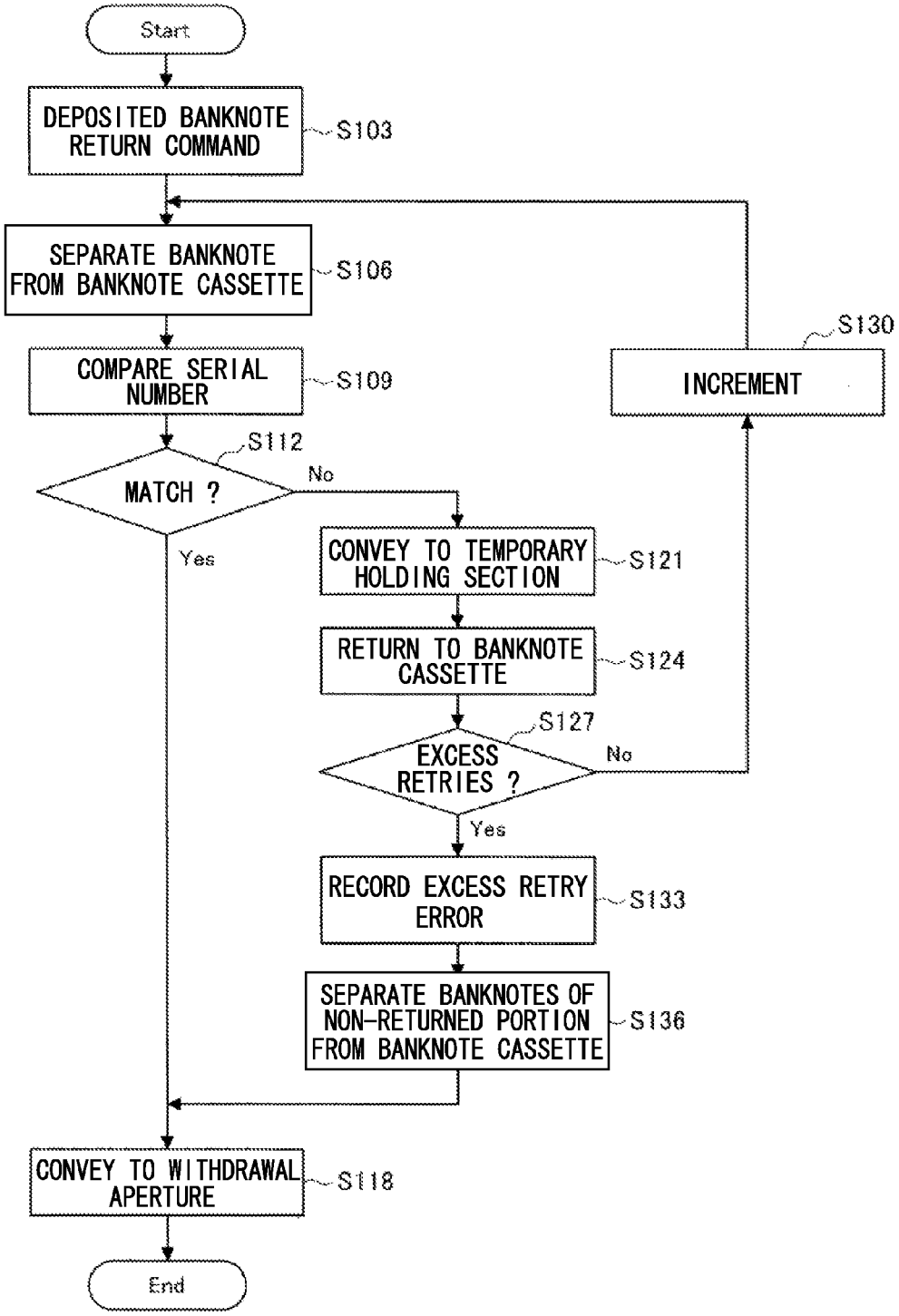
FIG. 9 is a flowchart showing return processing in accordance with a second embodiment.
Figure 10:
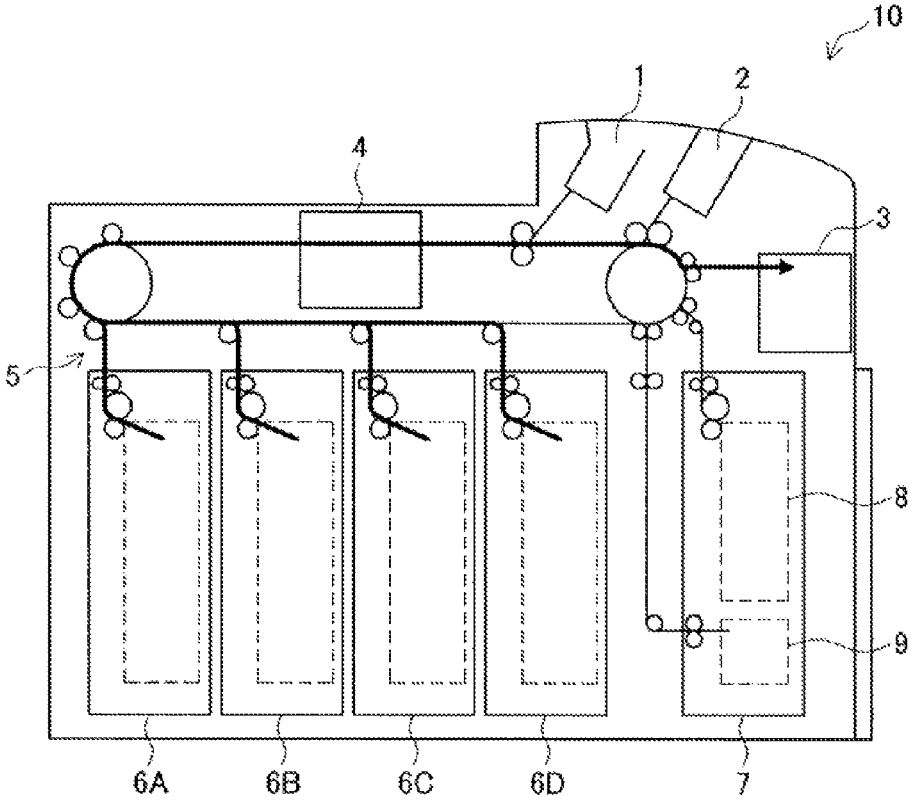
FIG. 10 is a diagram showing conveyance paths of serial number mismatch banknotes in accordance with the second embodiment.
Figure 11:
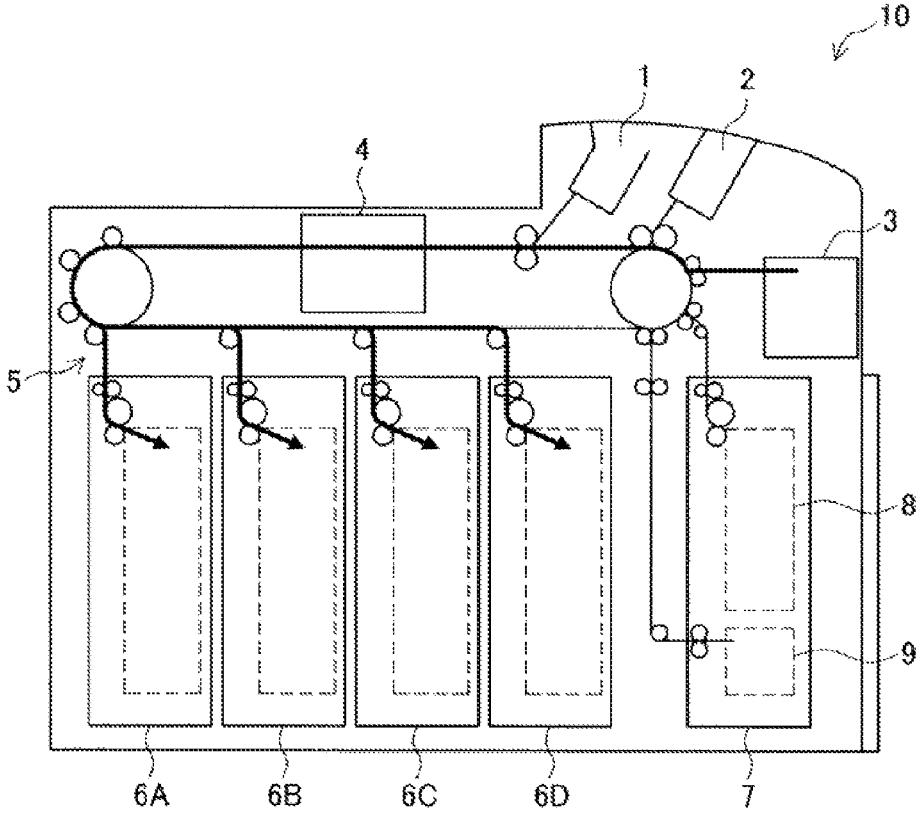
FIG. 11 is a diagram showing conveyance paths of the serial number mismatch banknotes in accordance with the second embodiment.

9 to FIG. 11. FIG. 9 is a flowchart showing return processing in accordance with the second embodiment. FIG. 10 and FIG. 11 are diagrams showing conveyance paths of serial number mismatch banknotes in accordance with the second embodiment.

In the above-described first embodiment, banknotes with non-matching serial numbers, which is to say banknotes that are not the actual deposited banknotes, are also returned to the customer. In contrast, in the second embodiment, the actual deposited banknotes are returned as assuredly as possible, by returning serial number mismatch banknotes to the banknote cassettes 6 and repeating the return processing.

Steps S103 to S112 shown in FIG. 9 carry out the same processing as the corresponding steps that have been described above with reference to FIG. 7.

In step S121 shown in FIG. 9, the conveyance control section 13 conveys any banknote that is determined by the result of the comparison by the comparison section 15 shown in step S112 to have a non-matching serial number (a serial number mismatch banknote) to the temporary holding section 3 as shown by the arrow in FIG. 10. The conveyance control section 13 also conveys any banknote whose serial number cannot be recognized by the banknote verification section 4 due to a traveling state or the like (an unrecognized serial number banknote) to the temporary holding section 3.

Next, in step S124, after banknotes are fed from the banknote cassettes 6A to 6D in correspondence with the number of banknotes to be returned, and the serial numbers thereof are compared by the comparison section 15, the conveyance control section 13 controls conveyance such that any banknotes stacked in the temporary holding section 3 are returned to the banknote cassettes 6A to 6D. Specifically, the conveyance control section 13 returns the banknotes stacked in the temporary holding section 3 (the serial number mismatch banknotes and unrecognized serial number banknotes) through the banknote verification section 4 to the banknote cassettes 6A to 6D corresponding to the denominations thereof, as shown by the arrows in FIG. 11.

In step S127, the control section 11 makes a determination as to whether a retry count has reached a predetermined retry count limit (for example, three). If the retry count limit has not been reached, the control section 11 increments the retry count in step S130.

Then the control section 11 repeats (as a retry operation) the processing of steps S106 to S124 (the second conveyance comparison processing). During the retry operation, the conveyance control section 13 controls the conveyance such that the banknotes are fed from the banknote cassettes 6A to 6D at a slow rate and the banknotes pass through the banknote verification section 4 at a slow rate. Thus, the accuracy of recognition of the banknotes by the banknote verification section 4 is improved.

Next, when it is determined in step S127 that the retry count has reached the retry count limit (excess retries), in step S133 the control section 11 memorizes information of an excess retry error in the memory section 12.

Then, in step S136, the conveyance control section 13 feeds out (separates) a non-returned portion of banknotes from the banknote cassettes 6A to 6D and, in step S118, conveys these banknotes to the withdrawal aperture 2. At this time, there is no recognition of the serial numbers by the banknote verification section 4 and comparison of the serial numbers by the comparison section 15, or the like.

As is described hereabove, according to the second embodiment, banknotes with serial number errors, such as serial number mismatches, unrecognized serial numbers and the like, are returned to the banknote cassettes 6 and the determinations are repeated in a retry operation. Thus, the proportion of returned banknotes that have matching serial numbers (the actual deposited banknotes) may be improved.

3-3. Third Embodiment

Figure 12:
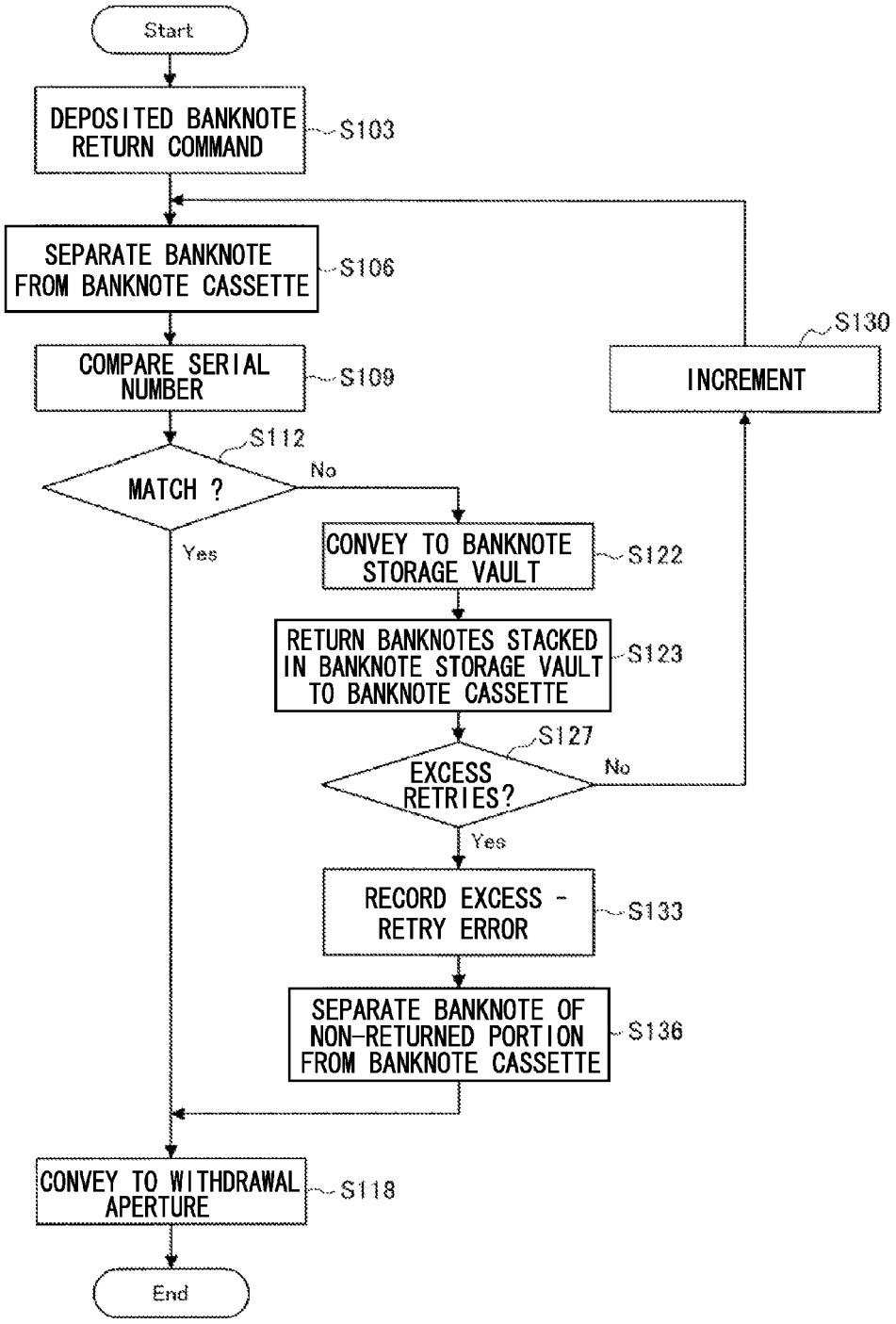
FIG. 12 is a flowchart showing return processing in accordance with a third embodiment.
Figure 13:
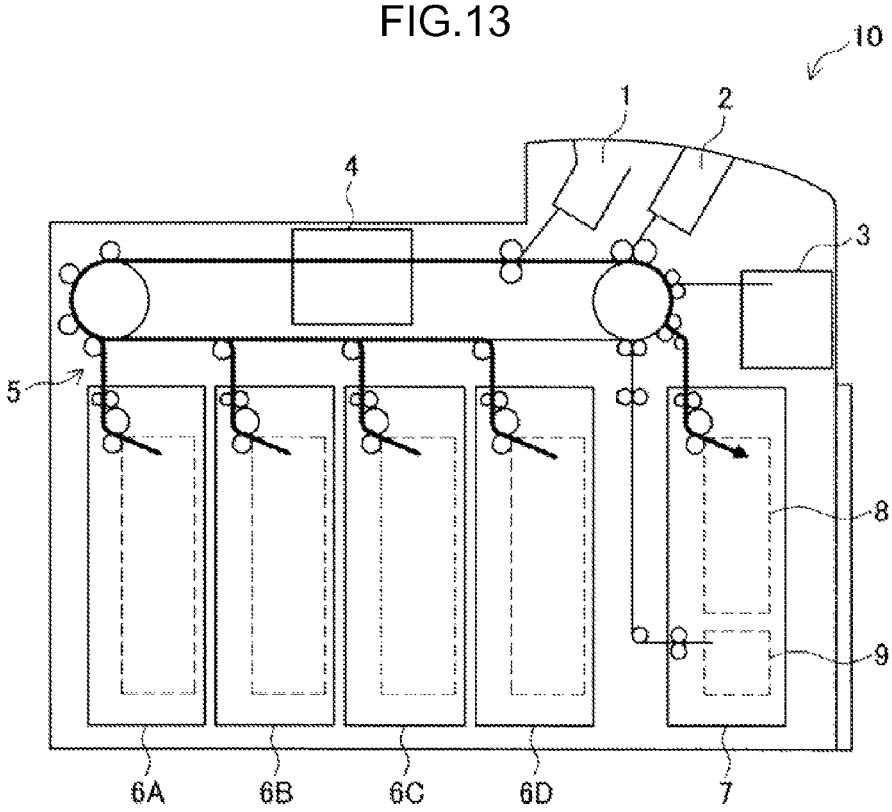
FIG. 13 is a diagram showing conveyance paths of serial number mismatch banknotes in accordance with the third embodiment.
Figure 14:
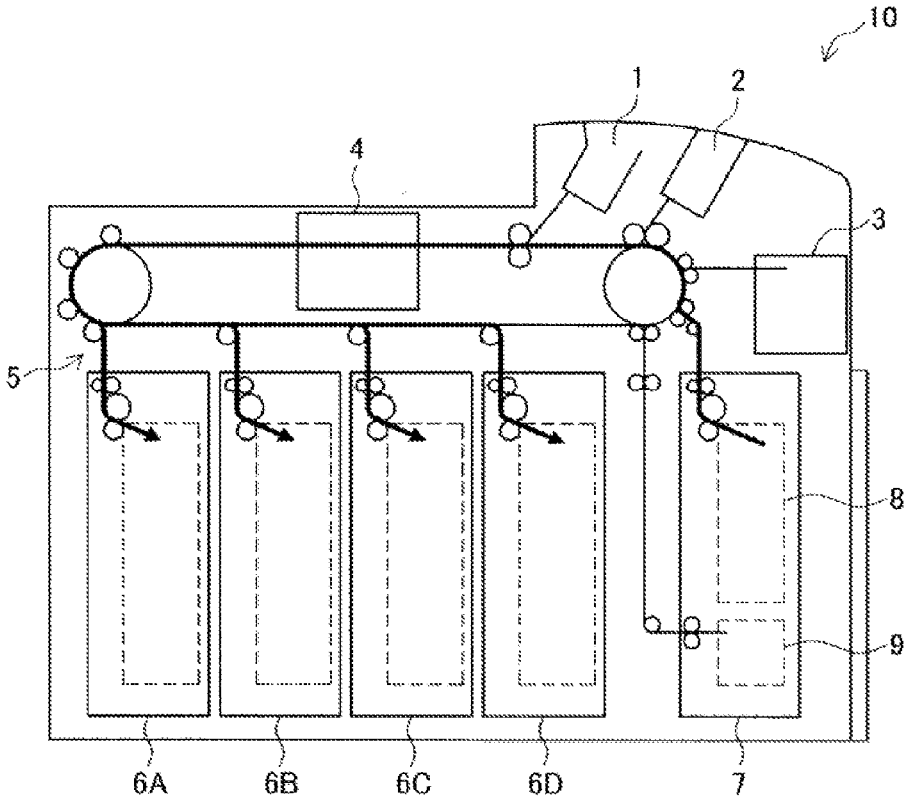
FIG. 14 is a diagram showing conveyance paths of the serial number mismatch banknotes in accordance with the third embodiment.

Now, a return of direct deposit banknotes in accordance with a third embodiment is described with reference to FIG. 12 to FIG. 14. FIG. 12 is a flowchart showing return processing in accordance with the third embodiment. FIG. 13 and FIG. 14 are diagrams showing the conveyance paths of serial number mismatch banknotes in accordance with the third embodiment.

In the second embodiment described above, a retry operation is carried out after the banknotes with serial number errors, such as serial number mismatches, unrecognized serial numbers and the like, are withdrawn to the temporary holding section 3. However, when the temporary holding section 3 cannot be used due to a malfunction or the like, the temporary holding section 3 is not included in the structure or the like, the deposited banknote return retry operation according to the second embodiment is not possible and the returned proportion of actual deposited banknotes is lowered. Accordingly, in the third embodiment, a retry operation is carried out using the banknote storage vault 8 (which is, for example, a restocking/recovery cassette) instead of the temporary holding section 3.

Steps S103 to S112 shown in FIG. 12 carry out the same processing as the corresponding steps that have been described above with reference to FIG. 9.

In step S122 shown in FIG. 12, the conveyance control section 13 conveys any banknote that is determined by the result of the comparison by the comparison section 15 shown in step S112 to have a non-matching serial number (a serial number mismatch banknote) to the banknote storage vault 8, as shown by the arrow in FIG. 13. The conveyance control section 13 also conveys any banknote whose serial number cannot be recognized by the banknote verification section 4 due to a traveling state or the like (an unrecognized serial number banknote) to the banknote storage vault 8.

Next, in step S123, after banknotes are fed from the banknote cassettes 6A to 6D in correspondence with the number of banknotes to be returned, and the serial numbers thereof are compared by the comparison section 15, then, the conveyance control section 13 controls conveyance such that any banknotes stacked in the banknote storage vault 8 are returned to the banknote cassettes 6A to 6D. Specifically, the conveyance control section 13 returns the banknotes stacked in the banknote storage vault 8 (the serial number mismatch banknotes and unrecognized serial number banknotes) through the banknote verification section 4 to the banknote cassettes 6A to 6D corresponding to the denominations thereof, as shown by the arrows in FIG. 14.

Subsequent steps S127 to S136 and step S118 carry out the same processing as the corresponding steps that have been described above with reference to FIG. 9.

As is described hereabove, according to the third embodiment, banknotes with serial number errors, such as serial number mismatches, unrecognized serial numbers and the like, are returned to the banknote cassettes 6 and the determinations are repeated in a retry operation. Thus, even when the temporary holding section 3 cannot be used due to a malfunction or the like, or in a structure that does not include the temporary holding section 3 or the like, deposited banknote return retry operations may be carried out and the proportion of actual deposited banknotes being returned may be improved.

3-4. Fourth Embodiment

Figure 15:
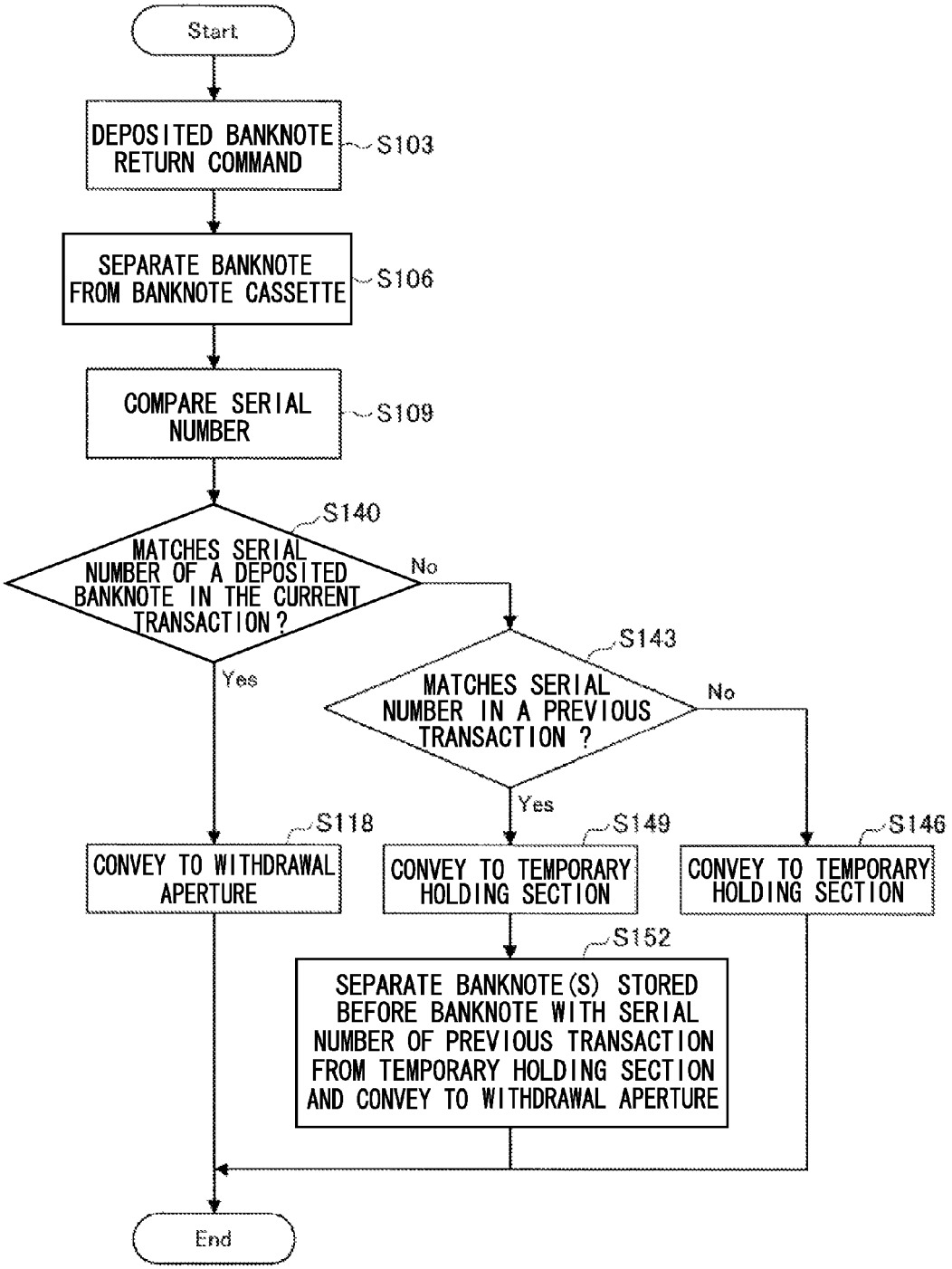
FIG. 15 is a flowchart showing return processing in accordance with a fourth embodiment.
Figure 16:
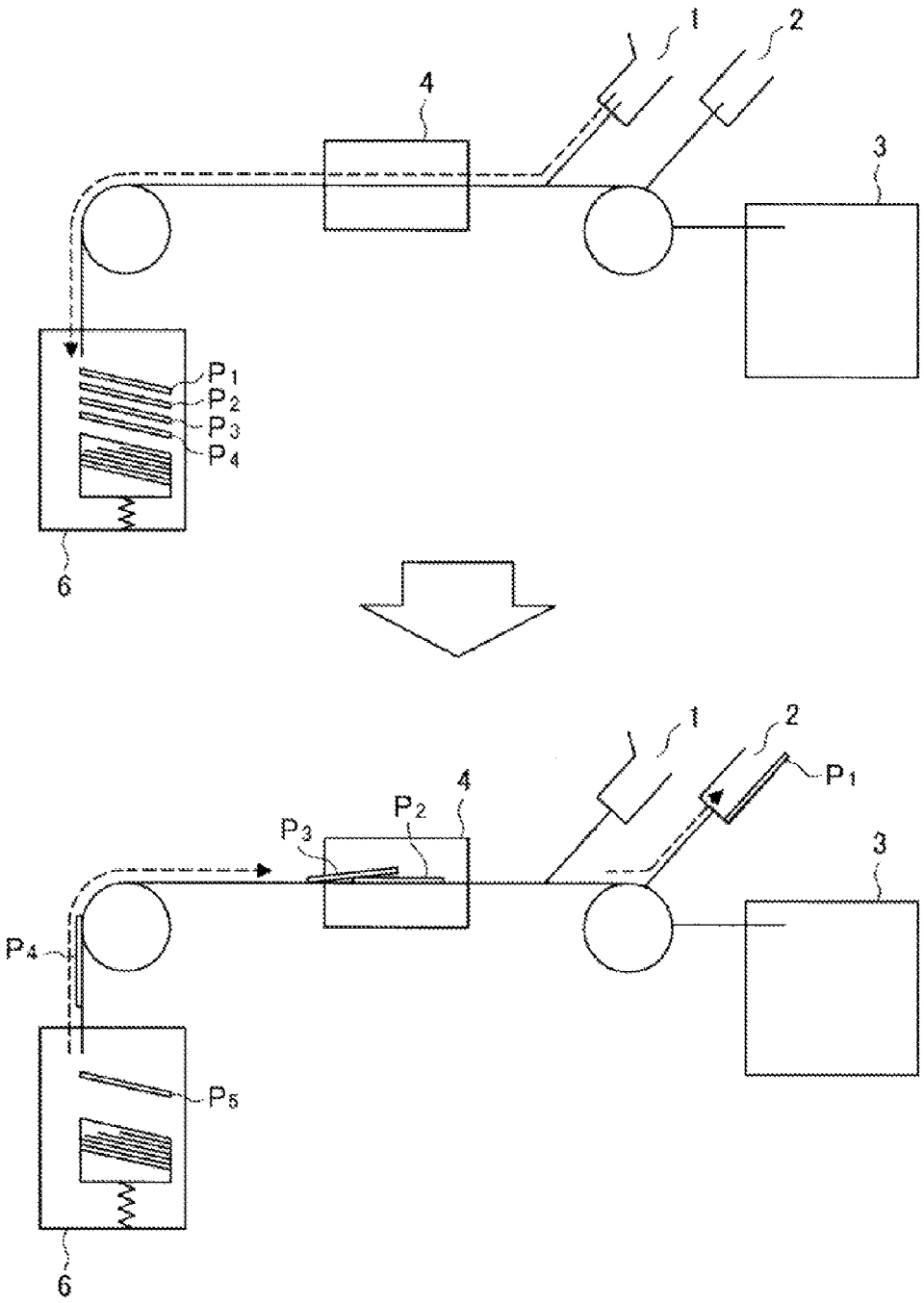
FIG. 16 is a diagram showing conveyance paths of banknotes in accordance with the fourth embodiment.
Figure 17:
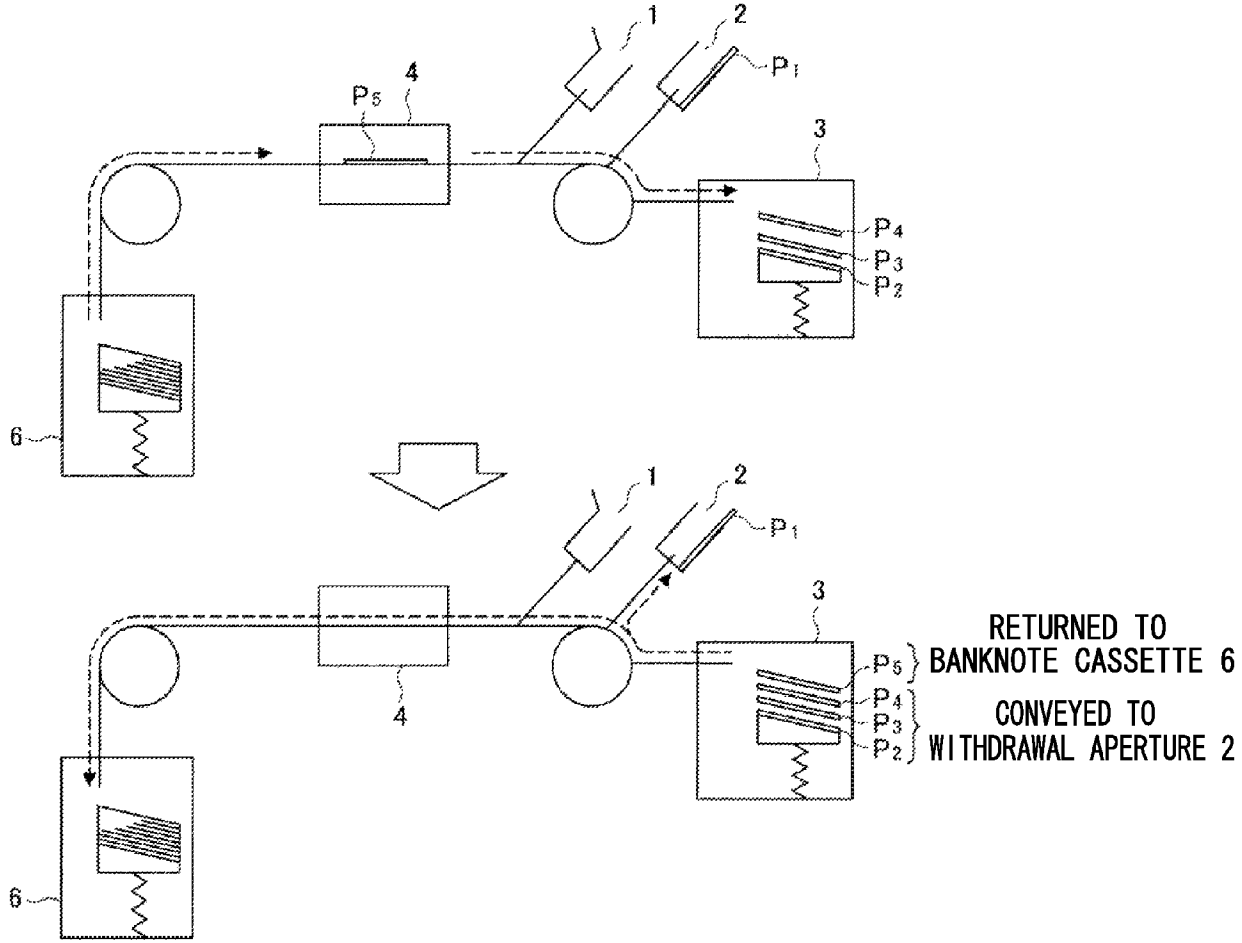
FIG. 17 is a diagram showing conveyance paths of the banknotes in accordance with the fourth embodiment.

Now, a return of direct deposit banknotes in accordance with a fourth embodiment is described with reference to FIG. 15 to FIG. 17. FIG. 15 is a flowchart showing return processing in accordance with the fourth embodiment. FIG. 16 and FIG. 17 are diagrams showing the conveyance paths of serial number mismatch banknotes in accordance with the fourth embodiment.

In the second and third embodiments described above, a retry operation is carried out by returning the banknotes with serial number errors, such as serial number mismatches, unrecognized serial numbers and the like, to the banknote cassettes 6. However, when the serial numbers of actual deposited banknotes cannot be read by the banknote verification section 4 due to traveling problems such as double-feeding or the like, retry operations are wastefully executed and a large amount of operation time is wasted. Accordingly, in the fourth embodiment, in addition to the comparison of serial numbers according to the first embodiment, the serial numbers that are recognized at the time of the second conveyance (during return processing) are compared with serial numbers from previous transactions. Thus, it is determined whether or not banknotes are the actual banknotes deposited in the current deposit. Herebelow, the fourth embodiment is described in specific terms.

First, a direct deposit according to the fourth embodiment is described with reference to FIG. 16. In the present embodiment, as shown in FIG. 16, banknotes $P_4$, $P_3$, $P_2$ and $P_1$ are successively separated one by one from the deposit aperture 1, and these banknotes are conveyed to the banknote verification section 4. The banknote verification section 4 recognizes the serial numbers of the banknotes conveyed thereto, and the recognized serial numbers are memorized in the memory section 12. The memory section 12 according to the present embodiment has also memorized the serial numbers of banknotes that have been stacked in the banknote cassettes 6 during previous transactions.

The banknotes are successively conveyed from the banknote verification section 4 to one of the banknote cassettes 6. As shown at the top of FIG. 16, the banknotes $P_4$, $P_3$, $P_2$ and $P_1$ are stacked in the banknote cassette 6 in this order. Hence, in the case in which the deposited banknotes are returned, it is desirable to return the banknotes $P_4$, $P_3$, $P_2$ and $P_1$ that are the actual deposited banknotes.

Now, the deposited banknote return processing is described with reference to FIG. 15. If deposited banknote return processing is instructed by a staff member at step S103 of FIG. 15, in step S106 the conveyance control section 13 separates banknotes from the banknote cassette 6 one by one, in accordance with the denominations and numbers of deposited banknotes, and controls conveyance such that each separated banknote is conveyed to the banknote verification section 4. The banknote verification section 4 recognizes the denomination, banknote condition and serial number of the banknote.

Then, in step S109, the comparison section 15 compares the serial number of the banknote recognized by the banknote verification section 4 (the characteristic information that is recognized at the time of a second conveyance) with serial numbers that have been previously memorized in the memory section 12. The serial numbers previously memorized in the memory section 12 include the serial numbers recognized in the current deposit transaction (the characteristic information that is recognized at the time of a first conveyance) and the serial numbers of banknotes stacked in the banknote cassette 6 in previous transactions (characteristic information recognized at the time of a previous conveyance).

Next, when it is determined by the comparison section 15 in step S140 that the serial number of a banknote conveyed to the banknote verification section 4 matches the serial number of a deposited banknote of the current transaction, in step S118 the conveyance control section 15 conveys the banknote from the banknote verification section 4 to the withdrawal aperture 2. For example, as shown at the bottom of FIG. 16, when it is determined that the serial number of banknote $P_1$ matches the serial number of a deposited banknote, banknote $P_1$ is stacked in the withdrawal aperture 2.

The banknotes $P_2$ and $P_3$ shown at the bottom of FIG. 16 are double-fed during the return conveyance, and the serial numbers thereof cannot be read by the banknote verification section 4. In addition, the serial number of banknote $P_4$ cannot be recognized during the return conveyance due to skewed traveling or some other factor. Accordingly, banknotes for which the banknote verification section 4 cannot recognize the serial numbers during the return conveyance (during the second conveyance) (in the example shown in FIG. 16, the banknotes $P_2$, $P_3$ and $P_4$) are determined to have serial number mismatches in step S140 and step S143, and in step S146 these banknotes are conveyed to the temporary holding section 3, as shown at the top of FIG. 17.

When it is determined by the comparison section 15 in step S140 that the serial number of a banknote conveyed to the banknote verification section 4 differs from the serial numbers of the deposited banknotes of the current transaction but matches a serial number from a previous transaction in step S143, in step S149 the conveyance control section 15 conveys this banknote from the banknote verification section 4 to the temporary holding section 3.

For example, a banknote $P_5$ shown in FIG. 16 was stacked in the banknote cassette 6 during a previous transaction. In this case, when the conveyance control section 13 is separating banknotes from the banknote cassette 6 in a number corresponding to the number of banknotes to be returned (four in the example shown in FIG. 16 and FIG. 17), banknotes $P_2$ and $P_3$ are combined by double feeding and counted as a second banknote, and banknote $P_4$ is counted as a third banknote. Therefore, the conveyance control section 13 separates banknote $P_5$ from the banknote cassette 6 as a fourth banknote and conveys banknote $P_5$ to the banknote verification section 4 as shown at the top of FIG. 17.

Because banknote $P_5$ is a banknote that was stacked in the banknote cassette 6 during a previous transaction, in step S143 it is determined by the comparison section 15 that banknote $P_5$ matches a serial number in a previous transaction. In the present embodiment, each banknote that has been conveyed before a banknote that was handled in a previous transaction is defined as an actual banknote deposited in the current transaction.

Accordingly, in step S149 banknote $P_5$ is withdrawn to the temporary holding section 3, after which, in step S152, banknote $P_5$ is separated from the temporary holding section 3 and returned to the banknote cassette 6. Then, the banknotes stored in the temporary holding section 3 before banknote $P_5$ are separated and conveyed to the withdrawal aperture 2.

As shown at the bottom of FIG. 17, the banknotes have been stacked in the temporary holding section 3 in the order $P_5$, $P_4$, $P_3$ and $P_2$ from the top. Therefore, the conveyance control section 13 returns banknote $P_5$ to the banknote cassette 6 and conveys banknotes $P_4$, $P_3$ and $P_2$ that were stored in the temporary holding section 3 before banknote $P_5$ to the withdrawal aperture 2.

As is described hereabove, according to the fourth embodiment, as well as the serial numbers of the time of the deposit transaction, the serial numbers of banknotes stacked in the banknote cassettes 6 at the times of previous transactions are memorized, and the serial numbers recognized by the banknote verification section 4 at the time of the return transaction are compared with these serial numbers. During the return transaction in the present embodiment, if an actual banknote of a previous transaction is identified, each banknote that has been conveyed before this banknote of the previous transaction and withdrawn to the temporary holding section 3 due to serial number non-recognition is determined to be an actual banknote of the current deposit, and is conveyed to the withdrawal aperture 2. Thus, in the present embodiment, unnecessary retry operations may be decreased, and the proportion of actual deposited banknotes that are returned may be improved.

4. Conclusion

As described hereabove, according to the embodiments of the present invention, individual banknotes are identified by comparing serial numbers during return processing after a direct deposit. Thus, whether or not the banknotes being returned are the actual banknotes deposited by a customer may be checked.

Specifically, according to the first embodiment, a staff member may check whether or not the actual banknotes deposited by the customer have been assuredly returned from whether there is serial number error information, which indicates that the serial number of a returned banknote differs from the serial numbers recognized during the deposit transaction, in the memory section 12.

According to the second embodiment, a proportion of actual deposited banknotes that are returned may be improved by returning banknotes with a serial number error to the banknote cassettes 6 and repeating determinations in a retry operation.

According to the third embodiment, even when the temporary holding section 3 cannot be used, a deposited banknote return retry operation may be carried out and the proportion of actual deposited banknotes that are returned may be improved by withdrawing banknotes with a serial number error to the banknote storage vault 8 instead of the temporary holding section 3.

According to the fourth embodiment, serial numbers of banknotes in previous transactions are memorized, and banknotes that are conveyed during return conveyance before a banknote of a previous transaction may be determined to be actual banknotes of the current deposit. Thus, unnecessary retry operations may be decreased and the proportion of actual deposited banknotes that are returned may be improved.

A preferable embodiment of the present invention has been described in detail while referring to the attached drawings, but the present invention is not limited to this example. It will be clear to the practitioner having ordinary skill in the field of art to which the present invention belongs that numerous modifications and improvements are possible within the scope of the technical gist recited in the attached claims, and it should be understood that these modifications and improvements are to be encompassed by the technical scope of the invention.

For example, a computer program may be prepared that causes hardware such as a CPU, ROM, RAM and the like incorporated in the banknote processing device 10 to realize functions equivalent to the comparison section 15 of the banknote processing device 10 described above. A storage medium on which this computer program is stored may be provided.

The embodiment described above describes application of the banknote processing device 10 according to the present embodiment to a staff-operated terminal, but the banknote processing device 10 according to the present embodiment is not limited thus. For example, the present embodiment may be applied to a cash processing section of a customer-operated terminal, which is an ATM as represented by ATMs of the type in which banknotes are circulated (recycled). These ATMs are installed in numerous locations such as banks, train stations, convenience stores and so forth. A customer may perform transactions such as deposits, withdrawals and balance enquiries by performing various operations on display screens displayed at the ATM.

The invention claimed is:

1. A banknote processing device comprising:

a deposit aperture;

a banknote verification section that recognizes characteristic information of deposited banknotes conveyed from the deposit aperture;

a banknote storage section in which stored banknotes, including the deposited banknotes, are stacked in stacks according to respective denominations and/or kinds;

a conveyance control section that controls conveyance of the deposited banknotes conveyed from the deposit aperture to the banknote verification section such that the deposited banknotes are conveyed directly to the banknote storage section from the banknote verification section, and that, upon a deposited banknote return command being detected, controls conveyance of a group of the stored banknotes such that a group of the stored banknotes is conveyed from the banknote storage section to the banknote verification section;

a comparison section that compares the characteristic information, that is recognized at a time of a first conveyance of the deposited banknotes from the deposit aperture to the banknote verification section, with characteristic information recognized at a time of a second conveyance of the group of the stored banknotes from the banknote storage section to the banknote verification section; and a memory section that, upon the comparison section determining that the characteristic information recognized at the time of the second conveyance differs from the characteristic information recognized at the time of the first conveyance, memorizes a characteristic information error, wherein the conveyance control section controls conveyance such that the group of the stored banknotes conveyed from the banknote storage section to the banknote verification section is ejected regardless of any result of the comparison by the comparison section.

2. A banknote processing device comprising:

a deposit aperture;

a banknote verification section that recognizes characteristic information of deposited banknotes conveyed from the deposit aperture;

a banknote storage section in which stored banknotes, including the deposited banknotes, are stacked;

a conveyance control section that controls conveyance of the deposited banknotes conveyed from the deposit aperture to the banknote verification section such that the deposited banknotes are conveyed directly to the banknote storage section from the banknote verification section, and that, upon a deposited banknote return command being detected, controls conveyance of first and second groups of the stored banknotes such that the first and second groups of the stored banknotes are conveyed from the banknote storage section to the banknote verification section;

a comparison section that compares the characteristic information, that is recognized at a time of a first conveyance of the deposited banknotes from the deposit aperture to the banknote verification section, with characteristic information recognized at a time of a second conveyance of each of the first and second groups of the stored banknotes from the banknote storage section to the banknote verification section; and a temporary holding section that temporarily stores the first group of the stored banknotes, wherein the conveyance control section controls conveyance so as to convey each of the first group of the stored banknotes, of which the characteristic information recognized at the time of the second conveyance is determined by the comparison section to differ from the characteristic information recognized at the time of the first conveyance, to the temporary holding section, wherein the conveyance control section controls conveyance of the second group of the stored banknotes, each of which the characteristic information recognized at the time of the second conveyance is determined by the comparison section to match the characteristic information recognized at the time of the first conveyance, so as to eject the second group of the stored banknotes, wherein the conveyance control section controls conveyance of the first group of the stored banknotes, that is stored in the temporary holding section, such that the first group of the stored banknotes is returned to the banknote storage section and, after the first group of the stored banknotes is returned, conveys the first group of the stored banknotes from the banknote storage section to the banknote verification section in a repeated second conveyance, and wherein the comparison section compares the characteristic information recognized at the time of the first conveyance of the deposited banknotes from the deposit aperture to the banknote verification section with characteristic information recognized at a time of the repeated second conveyance of the first group of the stored banknotes from the banknote storage section to the banknote verification section.

3. The banknote processing device according to claim 2, wherein the conveyance control section repeats the second conveyance a predetermined number of times.

4. A banknote processing device comprising:

a deposit aperture;

a banknote verification section that recognizes characteristic information of deposited banknotes conveyed from the deposit aperture;

a banknote storage section in which stored banknotes, including the deposited banknotes, are stacked;

a conveyance control section that controls conveyance of the deposited banknotes conveyed from the deposit aperture to the banknote verification section such that the deposited banknotes are conveyed directly to the banknote storage section from the banknote verification section, and that, upon a deposited banknote return command being detected, controls conveyance of first and second groups of the stored banknotes such that the first and second groups of the stored banknotes are conveyed from the banknote storage section to the banknote verification section;

a comparison section that compares the characteristic information, that is recognized at a time of a first conveyance of the deposited banknotes from the deposit aperture to the banknote verification section, with characteristic information recognized at a time of a second conveyance of each of the first and second groups of the stored banknotes from the banknote storage section to the banknote verification section; and a general-purpose banknote storage section that stores banknotes for use in at least one of restocking or recovery of banknotes, wherein the conveyance control section controls conveyance so as to convey each of the first group of the stored banknotes, of which the characteristic information recognized at the time of the second conveyance is determined by the comparison section to differ from the characteristic information recognized at the time of the first conveyance, to the general-purpose banknote storage section, wherein the conveyance control section controls conveyance so as to eject each of the second group of the stored banknotes, of which the characteristic information recognized at the time of the second conveyance is determined by the comparison section to match the characteristic information recognized at the time of the first conveyance, wherein the conveyance control section controls conveyance of the first group of the stored banknotes, that is stored in the general-purpose banknote storage section, such that the first group of the stored banknotes is returned to the banknote storage section and, after the first group of the stored banknotes has returned to the banknote storage section, conveys the first group of the stored banknotes from the banknote storage section to the banknote verification section in a repeated second conveyance, and wherein the comparison section compares the characteristic information recognized at the time of the first conveyance of the deposited banknotes from the deposit aperture to the banknote verification section with characteristic information recognized at a time of the repeated second conveyance of the first group of the stored banknotes from the banknote storage section to the banknote verification section.

5. The banknote processing device according to claim 4, wherein the conveyance control section repeats the second conveyance a predetermined number of times.

6. A banknote processing device comprising:

a deposit aperture;

a banknote verification section that recognizes characteristic information of deposited banknotes conveyed from the deposit aperture;

a banknote storage section in which stored banknotes, including the deposited banknotes, are stacked;

a conveyance control section that controls conveyance of the deposited banknotes conveyed from the deposit aperture to the banknote verification section such that the deposited banknotes are conveyed directly to the banknote storage section from the banknote verification section, and that, upon a deposited banknote return command being detected, controls conveyance of first and second groups of the stored banknotes such that the first and second groups of the stored banknotes are conveyed from the banknote storage section to the banknote verification section;

a comparison section that compares the characteristic information, that is recognized at a time of a first conveyance of the deposited banknotes from the deposit aperture to the banknote verification section, with characteristic information recognized at a time of a second conveyance of each of the first and second groups of the stored banknotes from the banknote storage section to the banknote verification section; and a temporary holding section that temporarily stores the first group of the stored banknotes, wherein the conveyance control section controls conveyance so as to convey each of the first group of the stored banknotes, of which the characteristic information recognized at the time of the second conveyance is determined by the comparison section to differ from the characteristic information recognized at the time of the first conveyance, to the temporary holding section, wherein the conveyance control section controls conveyance so as to eject each of the second group of the stored banknotes, of which the characteristic information recognized at the time of the second conveyance is determined by the comparison section to match the characteristic information recognized at the time of the first conveyance, and wherein the comparison section compares the characteristic information recognized at the time of the second conveyance with characteristic information of a previous banknote that is stored in the banknote storage section at a time of a previous transaction, and upon the characteristic information of one banknote of the first group of the stored banknotes recognized at the time of the second conveyance matching the characteristic information of the previous banknote stored at the time of the previous transaction, the conveyance control section controls conveyance so as to eject each banknote of the first group of the stored banknotes that has been conveyed to the banknote verification section and stored at the temporary holding section before the one banknote.

7. A banknote processing device comprising:

a deposit aperture;

a banknote verification section that recognizes characteristic information of deposited banknotes conveyed from the deposit aperture;

a banknote storage section in which stored banknotes, including the deposited banknotes, are stacked;

a conveyance control section that controls conveyance of the deposited banknotes conveyed from the deposit aperture to the banknote verification section such that the deposited banknotes are conveyed directly to the banknote storage section from the banknote verification section, and that, when a deposited banknote return command is detected, controls conveyance of first and second groups of the stored banknotes such that the first and second groups of the stored banknotes are conveyed from the banknote storage section to the banknote verification section;

a comparison section that compares the characteristic information, that is recognized at a time of a first conveyance of the deposited banknotes from the deposit aperture to the banknote verification section, with characteristic information recognized at a time of a second conveyance of each of the first and second groups from the banknote storage section to the banknote verification section; and a general-purpose banknote storage section that stores banknotes for use in at least one of restocking or recovery of banknotes, wherein the conveyance control section controls conveyance so as to convey each of the first group of the stored banknotes, of which the characteristic information recognized at the time of the second conveyance is determined by the comparison section to differ from the characteristic information recognized at the time of the first conveyance, to the general-purpose banknote storage section, wherein the conveyance control section controls conveyance so as to eject each of the second group of the stored banknotes of which the characteristic information recognized at the time of the second conveyance is determined by the comparison section to match the characteristic information recognized at the time of the first conveyance, and wherein the comparison section compares the characteristic information recognized at the time of the second conveyance with characteristic information of a previous banknote stored in the banknote storage section at a time of a previous transaction, and upon the characteristic information of one banknote of the first group of the stored banknotes recognized at the time of the second conveyance matching the characteristic information of the previous banknote stored at the time of the previous transaction, the conveyance control section controls conveyance so as to eject each banknote of the first group of the stored banknotes that has been conveyed to the banknote verification section and stored at the general-purpose banknote storage section before the one banknote.

* * * * *